United States Patent [19]

Spaulding

[11] Patent Number: 4,899,926

[45] Date of Patent: Feb. 13, 1990

[54] TWO WAY MAILER

[75] Inventor: Lincoln B. Spaulding, Weston, Mass.

[73] Assignee: Sheppard Envelope Company, Worcester, Mass.

[21] Appl. No.: 333,014

[22] Filed: Apr. 4, 1989

[51] Int. Cl.[4] ..... B65D 27/06; B65D 27/38

[52] U.S. Cl. ..... 229/73; 206/610; 206/629

[58] Field of Search ..... 206/604, 610, 620, 629; 229/73, 75

[56] References Cited

U.S. PATENT DOCUMENTS

| | | | |
|---|---|---|---|
| 886,449 | 5/1908 | West | 206/620 |
| 2,673,680 | 3/1954 | Deutschmeister | 229/73 |
| 2,686,005 | 8/1954 | Hyman | 229/73 |
| 2,872,099 | 2/1959 | Prial | 229/73 |
| 2,964,233 | 12/1960 | McFarland | 206/610 |
| 3,086,695 | 4/1963 | Lillibridge | 229/73 |
| 3,113,716 | 12/1963 | Howard | 229/73 |
| 3,802,618 | 4/1974 | Wiessner | 229/73 |
| 3,908,892 | 9/1975 | Pelzer | 229/73 |
| 4,382,539 | 5/1983 | Kronman | 229/73 |

FOREIGN PATENT DOCUMENTS

| | | | |
|---|---|---|---|
| 2117319 | 10/1983 | United Kingdom | 229/73 |

*Primary Examiner*—Stephen Marcus
*Assistant Examiner*—Kathryn M. Stemann
*Attorney, Agent, or Firm*—Samuels, Gauthier, Stevens & Kehoe

[57] ABSTRACT

A two way mailer is formed from a single blank of sheet material, and has separably interconnected forwarding and return envelopes sharing a common rear panel. The return envelope is separable from the forwarding envelope along perforated lines located exclusively or substantially exclusively outside of the front panel of the forwarding envelope. Vulnerable segments of the perforated lines are securely overlapped by the front closure flap of the forwarding envelope.

7 Claims, 5 Drawing Sheets

TWO WAY MAILER

DESCRIPTION OF THE INVENTION

1. Field of the Invention

This invention relates generally to envelopes, and is concerned in particular with a two way mailer comprising the separable combination of a forwarding envelope and a return envelope formed from a single blank of sheet material.

2. Description of the Prior Art

Two way mailers are already known, as evidenced for example by the disclosure in U.S. Pat. No. 4,487,360 (Fisher, et al.), as well as in the disclosures of a number of the prior art patents referred to therein. These known two way mailers suffer from various drawbacks, including for example difficult access to the contents of the forwarding envelope, difficult or awkward separation of the return envelope from the forwarding envelope, the possibility of damaging the contents of the forwarding envelope in the event of premature separation of the return envelope, unsightly perforated lines on the front face of the forwarding envelope, exposed segments of perforated lines which have a tendency to become caught up and inadvertently violated by the mechanisms of automatic envelope stuffers and other like handling machines, etc. Such drawbacks have retarded the widespread acceptance of two way mailers, particularly where the sender is concerned with the attractiveness of the forwarding envelope, and where the envelopes are to be automatically stuffed prior to being mailed to the recipients.

SUMMARY OF THE INVENTION

The present invention is directed to a novel and improved two way mailer which either obviates or at the very least substantially minimizes the above-noted drawbacks.

More particularly, the two way mailer of the present invention includes a return envelope having a rear panel which also serves as the rear panel for the forwarding envelope. The return envelope is detachably secured to the forwarding envelope along perforated lines which are located exclusively or substantially exclusively in the common rear panel, thereby leaving the front panel of the forwarding envelope essentially free of unsightly perforations. Critical end segments of the aforesaid perforated lines are overlapped by the front closure flap of the forwarding envelope, thereby safeguarding the mailer from inadvertent violation by automatic processing equipment.

The front closure flap of the forwarding envelope is opened in a conventional manner, and the return envelope is readily separable from the front panel of the forwarding envelope, thus facilitating both access to the contents of the forwarding envelope, and subsequent use of the return envelope. Because the perforated lines are located exclusively or substantially exclusively in the rear panel, separation of the return envelope is effected without damage to any contents of the forwarding envelope.

These and other features and advantages of the present invention will become more apparent as the description proceeds with the aid of the accompanying drawings, wherein:

DETAILED DESCRIPTION

Figure 1:
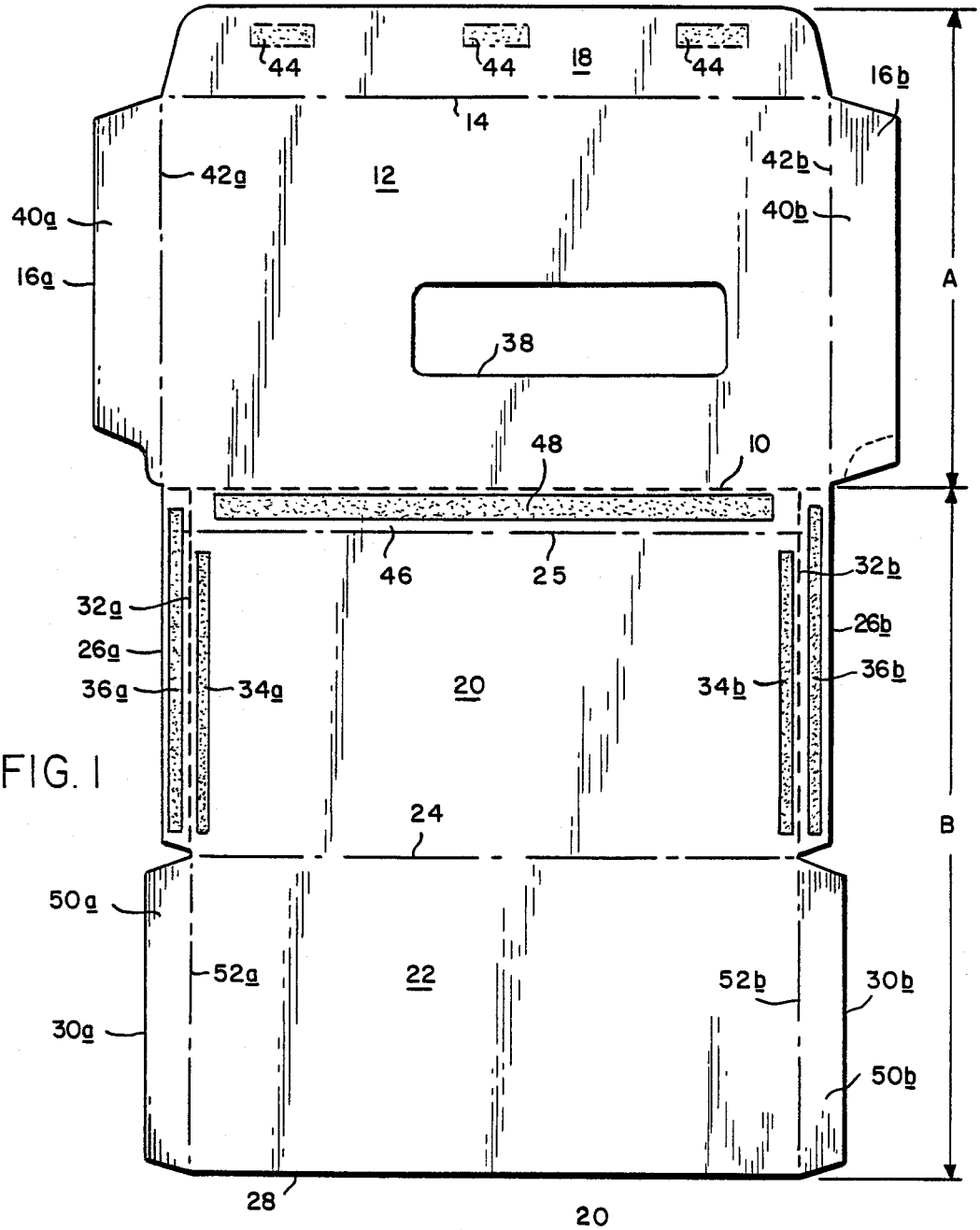
FIG. 1 is a plan view of a blank used to form one embodiment of the invention.

With reference initially to FIG. 1, a first embodiment of a two way mailer in accordance with the present invention is shown comprising a single blank of sheet material having first and second sections A,B separately interconnected at a first perforated line 10. The first section A includes a front panel 12 having a bottom edge coincident with the first perforated line 10, a top edge 14, and side edges 16*a*, 16*b*. A front closure flap 18 extends outwardly from the top edge 14 of the first panel.

The second section B includes a rear panel 20 and a return panel 22 joined one to the other at a fold line 24. The rear panel has a top edge 25, a bottom edge coincident with the fold line 24, and side edges 26*a*, 26*b*. The return panel 22 likewise has a bottom edge coincident with the fold line 24, a top edge 28, and side edges 30*a*, 30*b*.

Second perforated lines 32*a*, 32*b* are located in the rear panel 20 at locations spaced inwardly from and parallel to the respective side edges 26*a*, 26*b*. The second perforated lines 32*a*, 32*b* are perpendicular to and intersect with the first perforated line 10. In order to insure that a clean corner is created during separation along the first and second perforated lines, there may be some minute "bleed over" of the second perforated lines across the first perforated line. Practically speaking, however, and regardless of whether bleed overs occur, the second perforated lines 32*a*, 32*b* are located substantially exclusively in the rear panel, i.e., in the second section B. The fold line 24 and the top edges 25, 28 are parallel to the first perforated line 10.

A first adhesive means comprises glue lines 34*a*, 34*b* located on the rear panel 20 at locations spaced respectively inwardly of the second perforated lines 32*a*, 32*b*. A second adhesive means comprises glue lines 36*a*, 36*b* located on the rear panel at locations spaced respectively outwardly of the second perforated lines 32*a*, 32*b*.

The front panel 12 may be provided with a window opening 38 for viewing a mailing address printed on the contents to be stuffed into the forwarding envelope.

Additional window openings (not shown) also may be provided at selected locations in the front panel. Advantageously, the front panel 12 may also be provided with side flaps which are foldable inwardly about fold lines 42*a*, 42*b* aligned with the side edges 26*a*, 26*b* of the rear panel 20. A third adhesive means comprising glue spots 44 is provided on the front closure flap 18.

A return closure flap 46 extends outwardly from the top edge 25 of the rear panel. The return closure flap is detachably joined to the front panel 12 at the first perforated line 10, and is provided with a fourth adhesive means in the form of a glue line 48. Advantageously, the return panel 22 is also provided with side flaps 50*a*, 50*b* which are foldable inwardly about fold lines 52*a*, 52*b* aligned respectively with the second perforated lines 32*a*, 32*b*.

Figure 2:
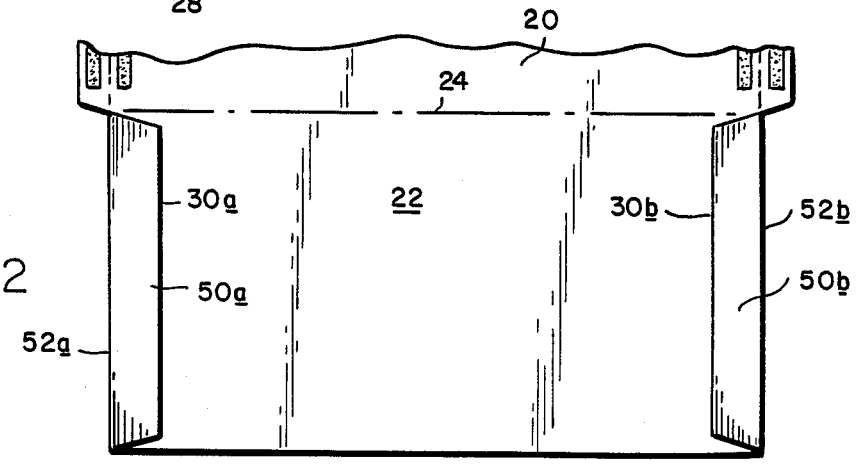
FIGS. 2–5 are views showing the sequential steps followed to form a two way mailer from the blank shown in FIG. 1.
Figure 3:
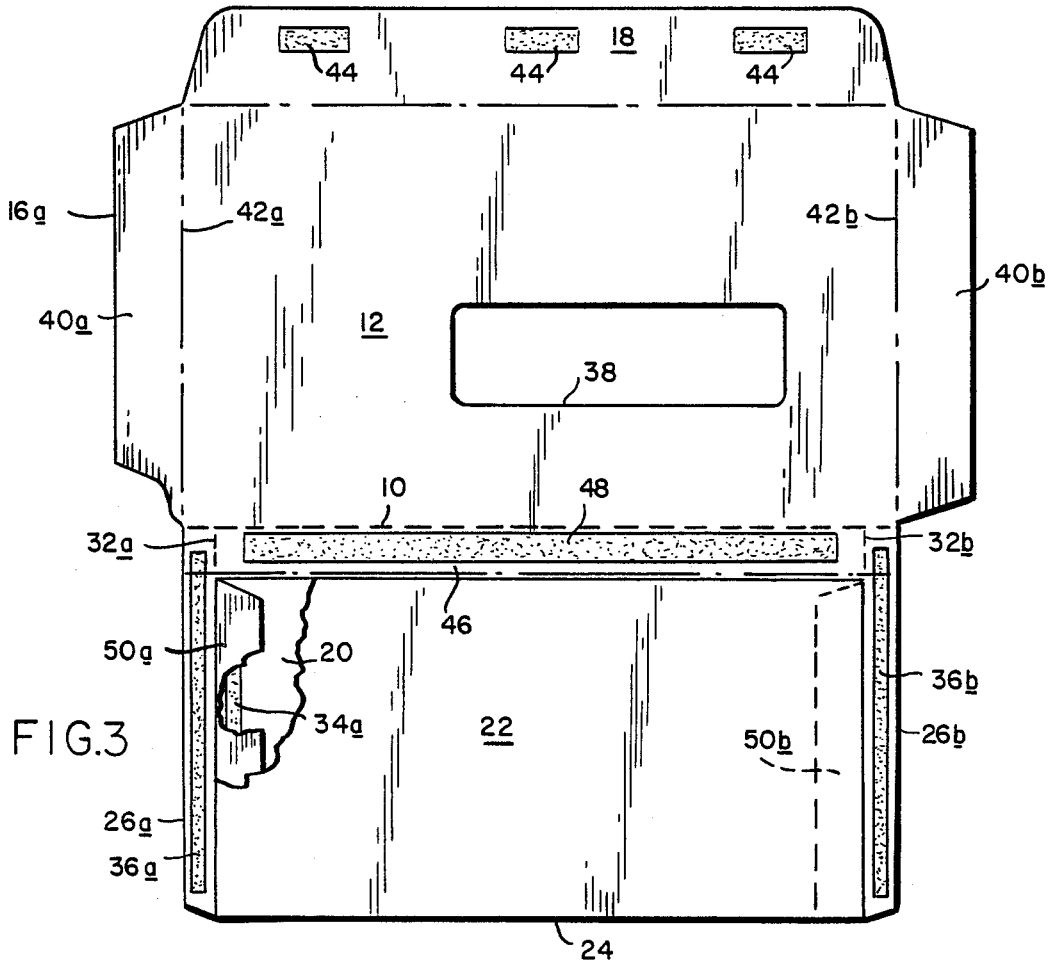

The blank illustrated in FIG. 1 is formed into a two way mailer in the following manner: as illustrated in FIG. 2, the side flaps 50*a*, 50*b* are initially folded inwardly about their respective fold lines 52*a*, 52*b* onto the return panel 22. Next, as shown in FIG. 3, the return panel 22 is folded about fold line 24 onto the rear panel 20, and the previously inwardly folded side flaps 50*a*, 50*b* are adhered to the rear panel by means of the glue lines 34*a*, 34*b*, thereby forming a return envelope.

Figure 5:
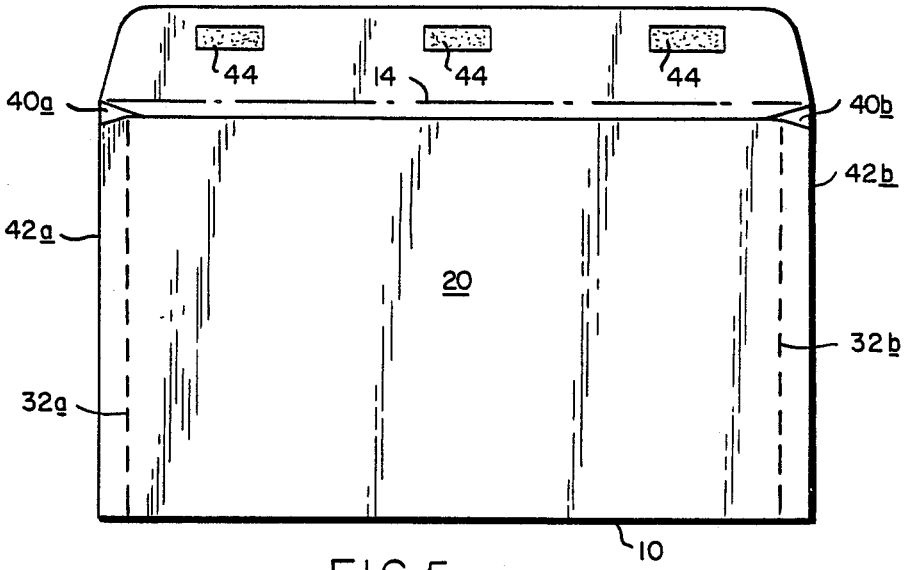
Figure 4:
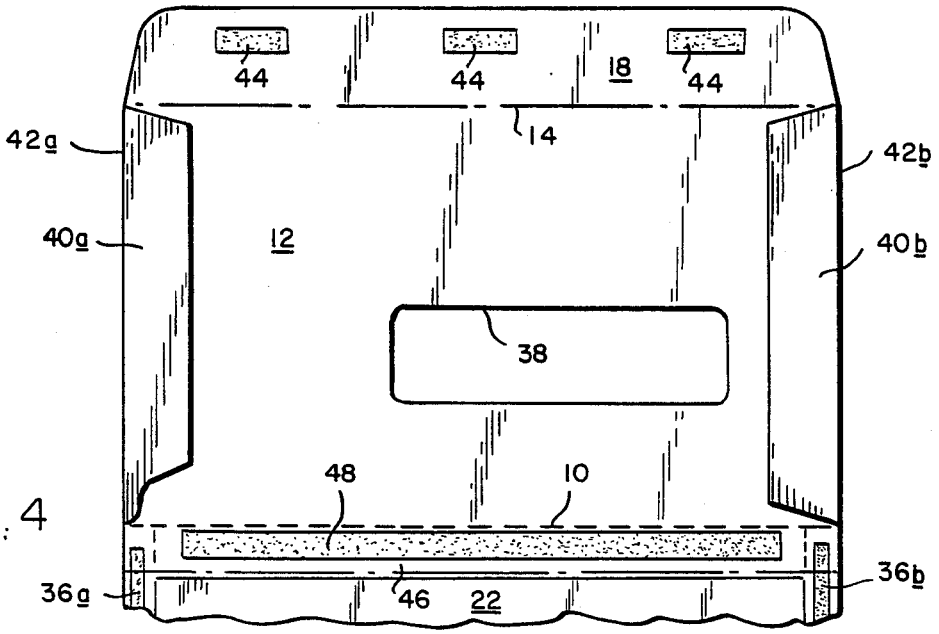
Figure 10:
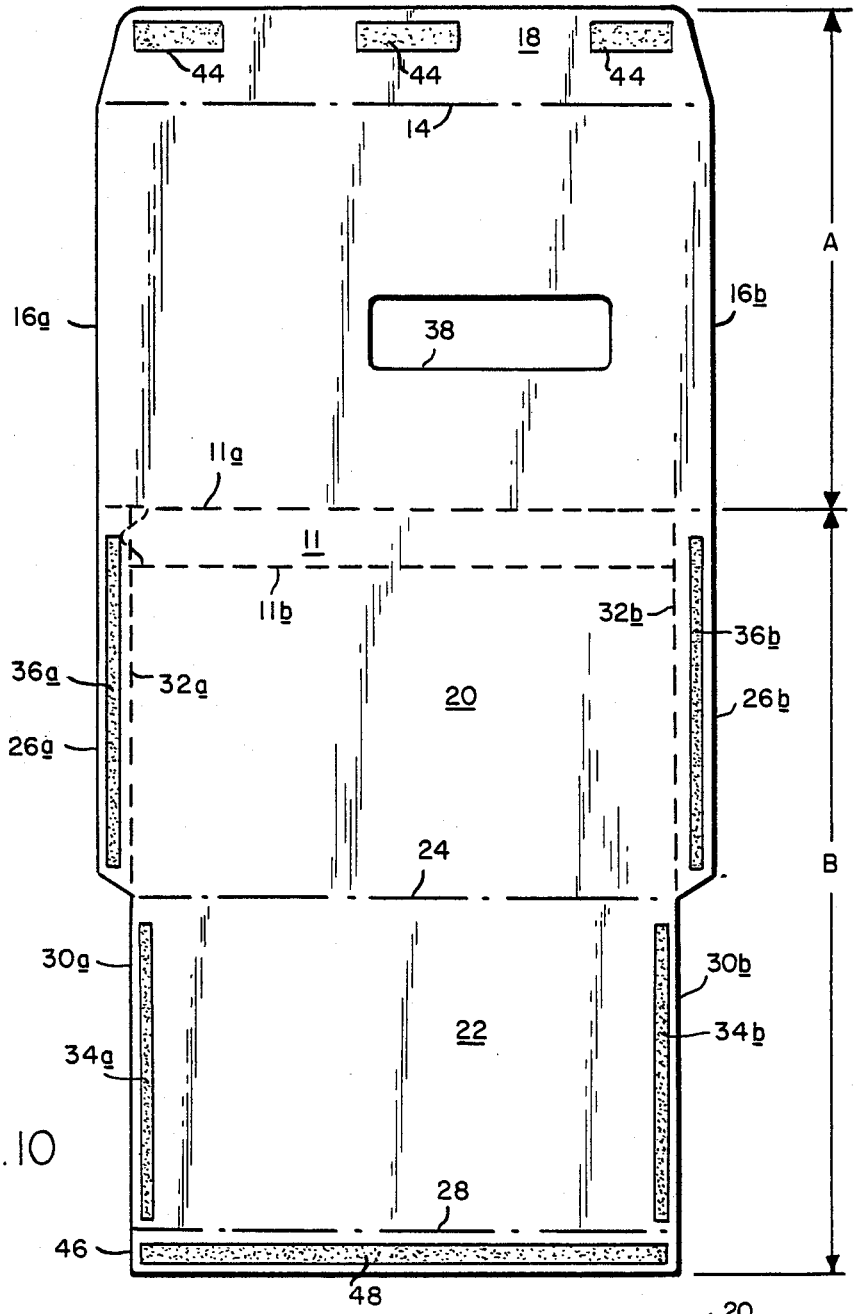
FIG. 10 is a plan view of a blank used to form a second embodiment of the invention.

Next, as shown in FIG. 4, the side flaps 40*a*, 40*b* are folded inwardly about their respective fold lines 42*a*, 42*b* , onto the front panel 12. Finally, as shown in FIG. 5, the return envelope is folded about the first perforated line 10 onto the front panel 12, and the inwardly folded side flaps 40*a*, 40*b* are adhered to the rear panel 20 by means of the glue lines 36*a*, 36*b* to thereby form the forwarding envelope.

Figure 6:
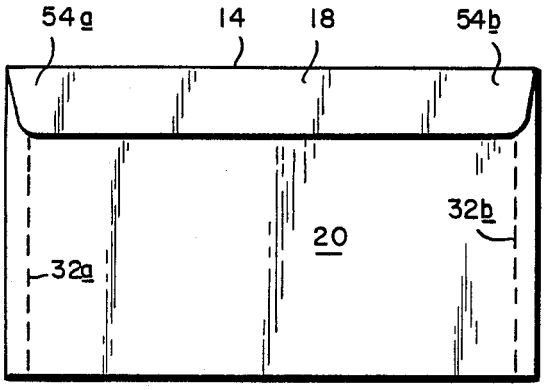
FIGS. 6 and 7 are rear and front views respectively of the resulting two way mailer after the front closure flap has been folded and sealed.
Figure 7:
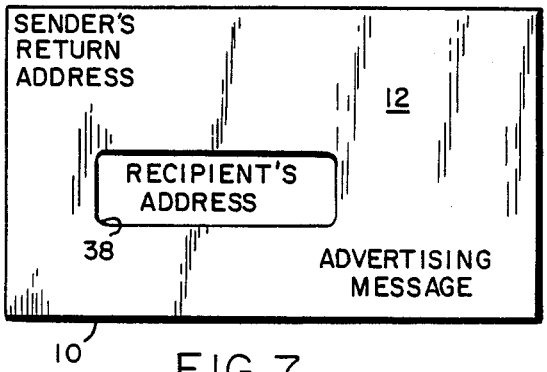

After the forwarding envelope has been stuffed, and as shown in FIG. 6, the front closure flap 18 is folded about the top edge 14 of the front panel 12 and is adhered to the rear panel 20 by means of the glue spots 44. The front of the thus filled and closed forwarding envelope is illustrated in FIG. 7. The recipient's address may be printed on the contents of the forwarding envelope for viewing through the window 38, and the sender's return address as well as any other appropriate indices, including advertising messages, may be printed on the front panel 12.

It will be understood that the above described folding sequence may be varied to accommodate various designs and production techniques. For example, under certain circumstances, it might be desirable to fold in both sets of side flaps 50*a*, 50*b*, 40*a*, 40*b* before folding the return and rear panels 22, 20.

A comparison of FIGS. 6 and 7 shows that the front panel 12 is free of unsightly perforated lines. More particularly, the first perforated line 10 runs along the bottom edge of the envelope, and the second perforated lines 32*a*, 32*b* are located exclusively or substantially exclusively in the rear panel 20. Most importantly, the second perforated lines 32*a*, 32*b* are overlapped as at 54*a*, 54*b* by the front closure flap 18 at vulnerable locations where they might otherwise be caught up and violated by automatic processing equipment, or by careless manual handling.

Figure 8:
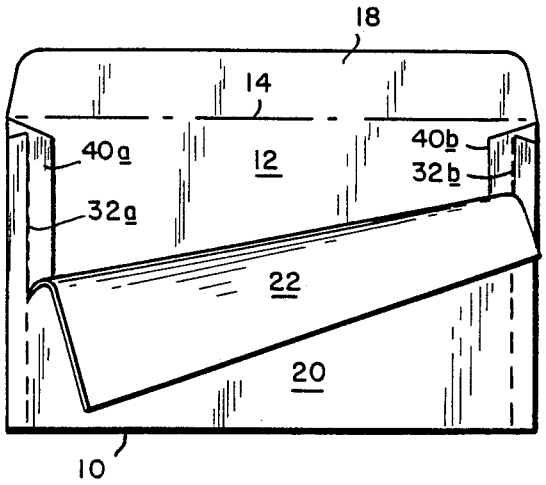
FIG. 8 is a rear view of the two way mailer, showing the front closure flap opened, and the return envelope in the process of being separated.
Figure 9:
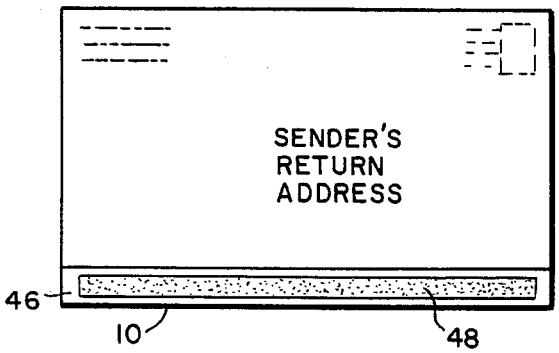
FIG. 9 is a front view of the return envelope following its separation from the forwarding envelope.

The recipient may gain access to the contents of the forwarding envelope by simply peeling open the front closure flap 18. Thereafter, as shown in FIG. 8, in order to make use of the return envelope, the recipient need only tear along the second perforated lines 32*a*, 32*b* and along the first perforated line 10. That portion of the rear panel 20 outside of the second perforated lines 32*a*, 32*b* which was adhered to the side flaps 40*a*, 40*b* of the front panel 20 by the glue lines 36*a*, 36*b* will remain secured to the front panel. By the same token, the rear and return panels will remain adhered to one another along the glue lines 34*a*, 34*b* located inwardly by the second perforated lines 32*a*, 32*b*. The thus separated return envelope, ready to be filled by the recipient, is shown in FIG. 9. After the return envelope is filled, it may be closed by folding the return flap 46 and securing it in place by means of the glue line 48.

A second embodiment of a two way mailer in accordance with the present invention is shown in FIGS. 10 to 15. Referring initially to FIG. 2, it will be seen that the second embodiment is similar to the first embodiment of FIGS. 1–9, except with regard to the following: (a) the front panel 12 lacks the side flaps 40*a*, 40*b* of the first embodiment, with the result that its side edges 16*a*, 16*b* are aligned with the side edges 26*a*, 26*b* of the rear panel 20; (b) the first perforated line 10 has been replaced by a separable tab 11 delineated by a first perforated lines 11*a* and by a parallel third perforated line 11*b*; (c) the return panel 22 lacks the side flaps 50*a*, 50*b*, with the result that its side edges 30*a*, 30*b* are aligned with the second perforated lines 32*a*, 32*b*; (d) the glue lines 34*a*, 34*b* of the first adhesive means are located on the return panel 22; and (e), the return closure flap 46 extends outwardly from the top edge 28 of the return panel 22.

Figure 11:
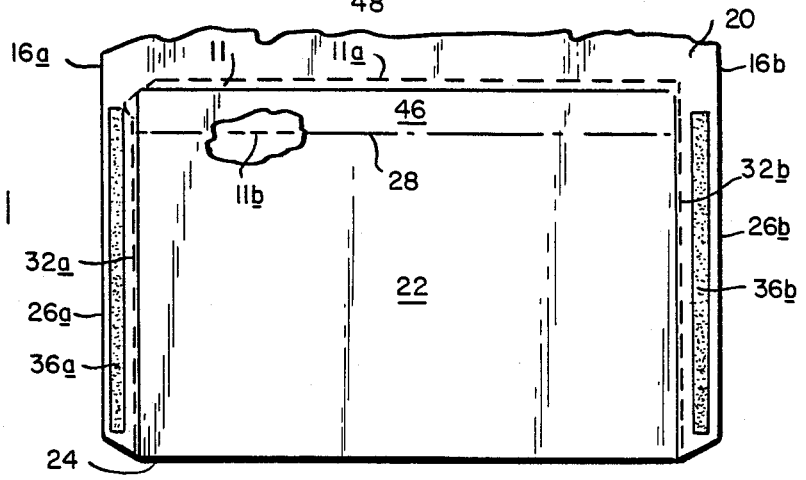
FIGS. 11 and 12 are views showing the sequential steps used to form a two way mailer from the second embodiment blank shown in FIG. 10.
Figure 12:
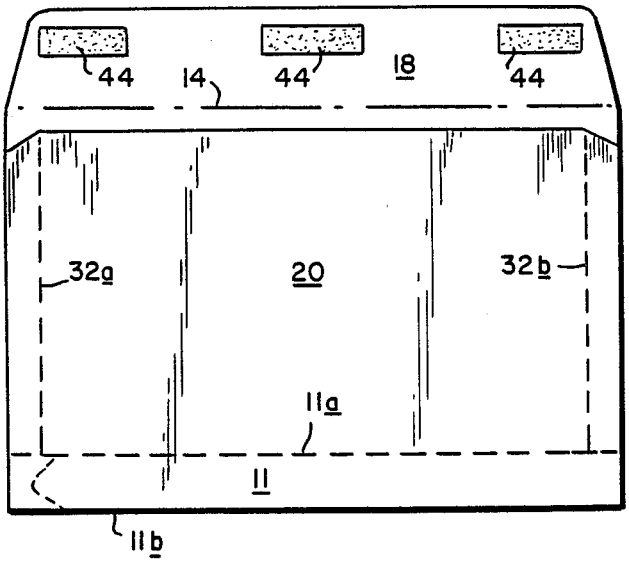

The procedure for forming the second embodiment into a two way mailer is as follows: as show in FIG. 11, the return panel 22 is folded about fold line 24 onto the rear panel 20, and the two panels are adhered together by the glue lines 34*a*, 34*b* at locations spaced inwardly from the second perforated lines 32*a*, 32*b*, thus forming the return envelope. The return closure flap 46 overlies the tab 11, with the top edge 28 of the return panel being aligned with the third perforated line 11*b*. As shown in FIG. 12, the return envelope is then folded about first perforated line 11*a* and is adhered to the front panel by means of the second glue lines 36*a*, 36*b*. This completes formation of the forwarding envelope.

Figure 13:
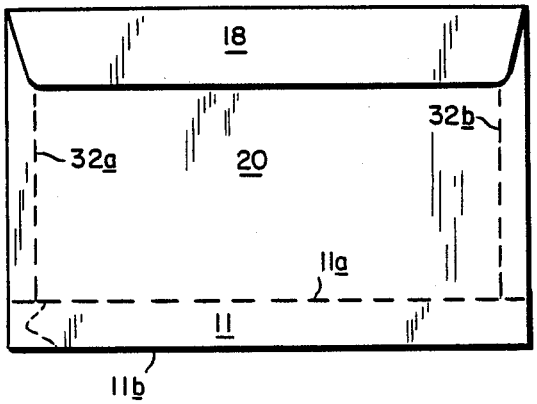
FIGS. 13 and 14 are rear and front views respectively of the second embodiment two way mailer after the front closure flap has been folded and sealed.
Figure 14:
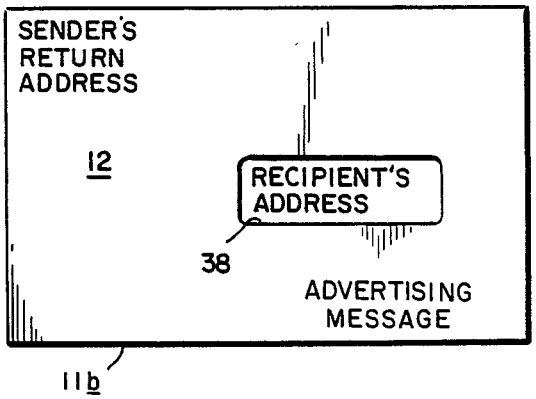

As shown in FIG. 13, after the forwarding envelope has been filled, it is closed by folding the front closure flap 18 about line 14 and adhering it to the rear panel 20 by means of the glue spots 44. It will thus be seen by comparing FIGS. 13 and 14 that the front panel 12 is again free of perforated lines, and that the second perforated lines 32*a*, 32*b* are safely overlapped by the front closure flap 18.

Figure 15:
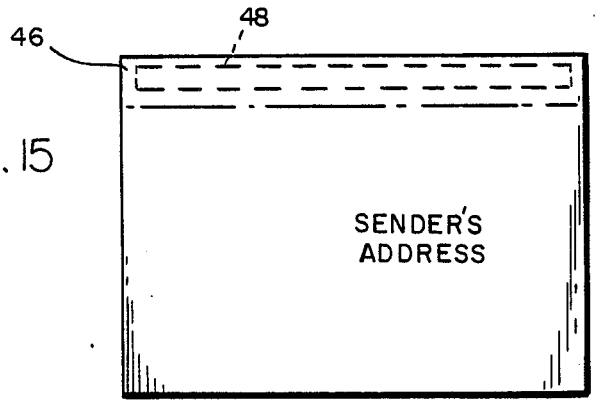
FIG. 15 is a front view of the return envelope after it has been separated and prior to its being closed and sealed.

Access to the contents of the forwarding envelope is again provided by simply peeling up the front closure flap 18. The return envelope is separated in this case by first peeling off the tab 11 along lines 11*a*, 11*b*. Then the folded and joined return and rear panels are separated from the front panel 12 along the second perforated lines 32*a*, 32*b*. The resulting return envelope is shown in FIG. 15.

Although not shown, it will be understood that the return panel 22 may also be provided with one or more window openings through which may be viewed preprinted addresses or other indicia on the contents of the return envelope.

I claim:

1. A two way mailer formed from a single blank of sheet material, comprising:

first and second sections;

means including a first perforated line for separately interconnecting said first and second sections;

said first section including a front panel having bottom, top and side edges, with a front closure flap extending outwardly from the top edge of said front panel;

said second section including rear and return panels, each having bottom, top and side edges, with a return closure flap extending outwardly from the top edge of one of said rear or return panels, and with second perforated lines located substantially exclusively in said second section, said second perforated lines being perpendicular to said first perforated line and being spaced inwardly from and parallel to the side edges of said rear panel, the bottom edges of said rear and return panels coincidentally defining a fold line parallel to said first perforated line and about which said return panel may be folded onto said rear panel;

first adhesive means for adhering the thus folded return panel to said rear panel at locations inside of said second perforated lines to thereby form a return envelope, the thus formed return envelope being foldable about said first perforated line onto said front panel;

second adhesive means for adhering the thus folded return envelope to said front panel at locations outside of said second perforated lines to thereby form a forwarding envelope;

said front closure flap being foldable about the top edge of said front panel and being dimensioned to close said forwarding envelope by overlapping said rear panel and said second perforated lines;

third adhesive means for securing the thus folded front closure flap to said rear panel, whereupon following opening said front closure flap, said return envelope may be separated from said front panel along said first and second perforated lines, with said return flap being foldable about its respective top edge to close the thus separated return envelope; and fourth adhesive means for securing the thus folded return flap in the closed position.

2. The two way mailer of claim 1 wherein said return panel includes side flaps which are foldable inwardly about fold lines aligned with said second perforated lines, and wherein the thus folded side flaps are adhered to said rear panel by said first adhesive means.

3. The two way mailer of claim 1 wherein said front panel includes side flaps which are foldable inwardly about fold lines aligned with the side edges of said rear panel, and wherein the thus folded return envelope is adhered to said flaps by said second adhesive means.

4. The two way mailer of claim 1 wherein said return closure flap extends outwardly from the top edge of said rear panel and is detachably joined to said front panel at said first perforated line.

5. The two way mailer of claim 1 wherein said return closure flap extends outwardly from the top edge of said return panel.

6. The two way mailer of claim 5 wherein the means for separately interconnecting said first and second sections includes a tab delineated by said first perforated line and by a third perforated line parallel to said first perforated line.

7. The two way mailer of claim 1 wherein said first and second adhesive means are located on said rear panel on opposite sides of each of said second perforated lines.

* * * * *